United States Patent [19]

Kaufman

[11] 4,025,745

[45] May 24, 1977

[54] CENTRIFUGAL SWITCHES

[76] Inventor: Paul Kaufman, 880 Red Oaks Drive, Elberon, N.J. 07740

[22] Filed: Dec. 15, 1975

[21] Appl. No.: 640,509

[52] U.S. Cl. ..... 200/80 A; 200/226

[51] Int. Cl.[2] ..... H01H 35/10

[58] Field of Search ..... 200/80 A, 182, 220, 200/223, 226

[56] References Cited

UNITED STATES PATENTS

| | | | |
|---|---|---|---|
| 1,031,893 | 7/1912 | Volk | 200/80 A |
| 1,412,228 | 4/1922 | Anderson et al. | 200/80 A |
| 2,472,332 | 6/1949 | Kohl | 200/80 A |
| 2,699,475 | 1/1955 | Gardes | 200/80 A |
| 2,714,640 | 8/1955 | Ferris | 200/80 A |
| 2,773,951 | 12/1956 | Finlay, Jr. et al. | 200/80 A |
| 3,098,906 | 7/1963 | Hermann | 200/80 A |
| 3,193,746 | 7/1965 | Neyhouse | 200/80 A |

*Primary Examiner*—Herman Hohauser
*Attorney, Agent, or Firm*—Nathan Edelberg; Robert P. Gibson; Charles R. Carter

[57] ABSTRACT

A centrifugal switch employing the fluent and electrical conducting properties of mercury to open or close an electrical circuit. The mercury is confined within an enclosed chamber and is used as an electrical conducting connector between spaced contact members. Rotating and nonrotating conditions of the switch are relied upon for electrical conduction through the mercury for switch operation.

2 Claims, 8 Drawing Figures

CENTRIFUGAL SWITCHES

DEDICATORY CLAUSE

The invention described herein may be manufactured, used, and licensed by or for the Government for governmental purposes without the payment to me of any royalties thereon.

BACKGROUND OF THE INVENTION

This invention relates to the field of centrifugal switches. No device is known that utilizes the fluent property of mercury in a centrifugal environment to cause actuation of a switch.

SUMMARY OF THE INVENTION

The present invention has provided a device wherein mercury is confined in an enclosed chamber and is used as a conducting member between spaced electrical contacts. Conduction through the mercury is effected by the position of the mercury caused by the static or non-rotation condition or by the dynamic or rotating conditions.

This invention may be better understood from the following detailed description taken in conjunction with the accompanying drawings.

DESCRIPTION OF THE PREFERRED EMBODIMENTS

Figure 1:
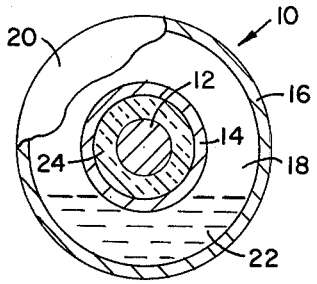
FIG. 1 is a side view of one switch embodiment in a static condition.
Figure 2:
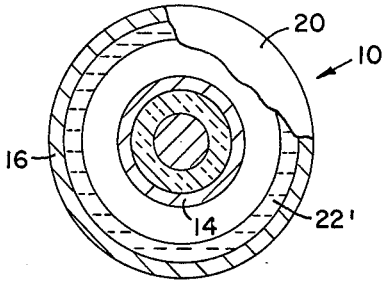
FIG. 2 is a side view of the embodiment of FIG. 1 in a rotating condition.

The switch 10 depicted in the embodiment of FIGS. 1 and 2 is mounted on a shaft 12 of a motor such as a single phase, split phase induction motor. As seen in these figures the switch consists of two concentric metallic rings 14, 16 of different diameters. The rings are of different diameters to provide a cylindrical chamber 18 therebetween. The outer faces of the rings and chamber are closed by end plates 20 attached thereto which are non-conducting. A specified quantity of mercury 22 is placed in the chamber so that electrical contact is formed between the rings and the mercury. The inner side of ring 14 is provided with a layer of electrical insulation material 24 for mounting purposes.

In the static or non-rotating position shown in FIG. 1 electrical conduction is made by the mercury contact between rings 14 and 16. When the switch is rotated as seen in FIG. 2 the mercury is centrifugally thrown against the inside wall of the outer ring 16 and forms a circular ring of mercury 22'. In this position of switch rotation the electrical conduction is broken.

Figure 3:
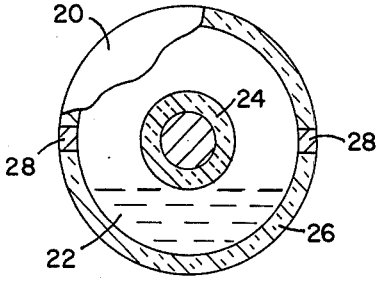
FIG. 3 is a side view of a second switch embodiment in a static condition.
Figure 4:
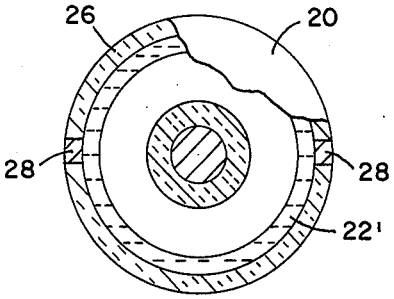
FIG. 4 is a side view of the embodiment of FIG. 3 in a rotating condition.
Figure 5:
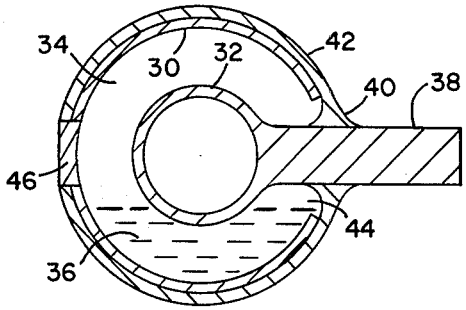
FIG. 5 is a side view of a third switch embodiment in a static condition.

The second switch modification shown in FIGS. 3 and 4 could be used in a system requiring initiation of fan-cooling before start-up or loading. This switch includes a single concentric ring made up of two insulation segments 26 and two metal segments 28 disposed on opposite sides of the ring and are separated by the insulation segments. The switch includes the chamber 18, end plates 20 and mercury 22 as shown in FIGS. 1 and 2. As shown in FIG. 3 the switch is non-conducting when it is non-rotating and the mercury does not contact the metal elements simultaneously. When the switch is caused to rotate, the mercury is also thrown against the inside wall of the ring to form the circular ring of mercury 22' so that electrical conduction is made by mercury ring contact between elements 28.

Figure 6:
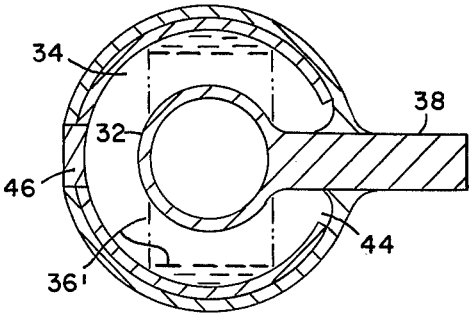
FIG. 6 is a side view of the embodiment of FIG. 5 in a rotating condition.

The switches shown in FIGS. 5–8 are employed for use in any orientation of the axis of rotation. Referring now to the embodiment shown in FIGS. 5 and 6 the switch consists of two concentric metallic spheres 30 and 32 of different diameters. A spherical chamber 34 is formed between the two spheres and a specific quantity of mercury 36 is placed in the chamber so that electrical contact is formed between the spheres and the mercury. A conducting metallic shaft 38 supports the inner sphere 32, penetrating through a portion 40 of an insulated outer sphere 42. Sphere 30 is provided with an opening 44 allowing shaft 38 to pass and not contact shaft 38 to prevent short circuits. Sphere 30 is also provided with a contact 46 for completing the switch contact elements. When the switch is rotated as seen in FIG. 6, the mercury is centrifugally thrown against the inside wall of sphere 30 and forms a ring of mercury 36' and thus breaks electrical conduction. The conducting support shaft 38 is in line with the axis of rotation.

Figure 7:
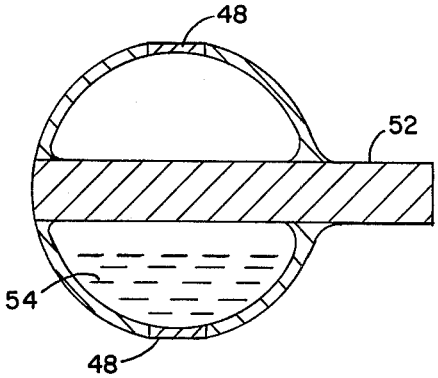
FIG. 7 is a side view of a fourth switch embodiment in a static condition.
Figure 8:
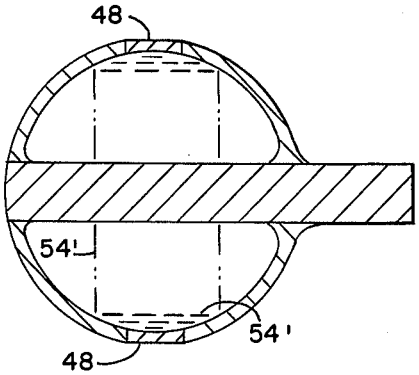
FIG. 8 is a side view of the embodiment of FIG. 7 in a rotation condition.

In the embodiment of FIGS. 7 and 8 metal segments 48 are on opposite ends of a diameter of an otherwise non-conducting sphere 50 that is rotated by shaft 52. As shown in FIG. 7 the switch is non-conducting when it is non-rotating and the mercury 54 does not contact the metal segments simultaneously. In rotating the sphere electrical conduction is made by mercury ring 54' contacting the segments simultaneously. The diameter between the segments 48 is in a plane perpendicular to the axis of rotation.

I claim:

1. A centrifugal switch disposed for use in making or breaking a circuit comprising a pair of electrical contact members in spaced relationship to each other, said members being concentric metallic rings of different diameters, a cylindrical chamber provided between said rings; electrical insulation provided on the interior of the smallest diameter metallic ring for insulation mounting of said switch; a liquid for conducting electrical current between said electrical contact members, said liquid being mercury and disposed for displacement from a first static position to a second position for making or breaking said circuit responsive to rotation of said switch.

2. A centrifugal switch disposed for use in making or breaking a circuit comprising a pair of electrical contact members in spaced relationship to each other, said members being concentric metallic spheres of different diameters, a spherical chamber provided between said spheres, electrical insulation provided around the outside of the largest diameter metallic sphere for insulation mounting of said switch; a liquid for conducting electrical current between said electrical contact members, said liquid being mercury and disposed for displacement from a first static position to a second position for making or breaking said circuit responsive to rotation of said switch.

* * * * *